US005722750A

United States Patent [19]

Chu

[11] Patent Number: 5,722,750

[45] Date of Patent: Mar. 3, 1998

[54] STRUCTURE OF SLIDING TRACK FOR DRAWERS

[76] Inventor: Leo Chu, 5F., No. 38, Lane 239, Chin Ping Rd., Chungho City, Taipei Hsien, Taiwan

[21] Appl. No.: 797,456

[22] Filed: Feb. 6, 1997

[51] Int. Cl.[6] ..... A47B 88/00

[52] U.S. Cl. ..... 312/334.11; 312/334.46

[58] Field of Search ..... 312/334.11, 334.46, 312/334.1, 334.7, 334.8, 334.44, 334.17; 384/18, 21, 22

[56] References Cited

U.S. PATENT DOCUMENTS

| | | | |
|---|---|---|---|
| 4,932,792 | 6/1990 | Baxter | 312/334.46 |
| 5,466,060 | 11/1995 | Hoffman | 312/334.44 |
| 5,577,821 | 11/1996 | Chu | 312/334.11 |

*Primary Examiner*—Peter M. Cuomo
*Assistant Examiner*—Gerald A. Anderson
*Attorney, Agent, or Firm*—Varndell Legal Group

[57] ABSTRACT

A sliding track assembly including an outer rail fixed to a cabinet, an intermediate rail an inner rail fixed to a drawer, a first sliding ball rack slidably connected between the outer rail and the intermediate rail, a second sliding ball rack slidably connected between the intermediate rail and the inner rail, a first stop plate fixed to the intermediate rail and having two projecting blocks for engagement with a second stop plate on the inner rail and two stop rods for stopping the second sliding ball rack in place, a second stop plate fixed to the inner rail to engage with the projecting blocks of the first plate so as to stop the drawer is place when the drawer is pulled out of the cabinet, wherein first stop plate has two parallel locating plates at the back, each locating plate having a longitudinal split and a rear bevel edge; the second sliding ball rack has two sliding faces at the bottom; the bevel edges of the locating plates guide the sliding faces of the second sliding ball rack into close contact with the locating plates of the first stop plate when the drawer is pulled out of the cabinet and the inner rail is moved with the drawer to force the second sliding ball rack into engagement with the first stop plate.

1 Claim, 13 Drawing Sheets

STRUCTURE OF SLIDING TRACK FOR DRAWERS

BACKGROUND AND SUMMARY OF THE INVENTION

The present invention relates to an improved structure of sliding track assembly for drawers which improves the structure of the sliding track assembly disclosed in U.S. Pat. No. 5,577,821.

According to U.S. Pat. No. 5, 577, 821, as shown in FIGS. from 1 to 4, the stop rods of the first stop plate have a respective projecting portion stopped at the two opposite projecting portions of the second sliding ball rack. Therefore, when the drawer is inserted into the inside wall of the cabinet again, the front end of the inner rail can smoothly be moved over the stop rods into the second sliding ball rack without being constrained by the projecting portions of the outer end of the second sliding ball rack. However, frequently rubbing the projecting portions of the stop rods over the projecting portions of the second sliding ball rack causes the projecting portions to wear quickly. When the projecting portions of the stop rods start to wear, they will be unable to be maintained in close contact with the projecting portions of the second sliding ball rack, thereby causing the drawer unable to smoothly be moved in the cabint.

The present invention has been accomplished to provide an improved structure of sliding track assembly which eliminates the aforesaid problem. According to the present invention, the first stop plate has two parallel locating plates at the back, each locating plate having a longitudinal split and a rear bevel edge; the second sliding ball rack has two sliding faces at the bottom; the bevel edges of the locating plates guide the sliding faces of the second sliding ball rack into close contact with the locating plates of the first stop plate when the drawer is pulled out of the cabinet and the inner rail is moved with the drawer to force the second sliding ball rack into engagement with the first stop plate. The longitudinal splits of the locating plates of the first stop plate impart a springy force to the bevel edges of the locating plates of the first stop plate, enabling the sliding faces of the second sliding ball rack to be moved into engagement with the locating plates of the first stop plate firmly without causing much friction resistance.

BRIEF DESCRIPTION OF THE DRAWINGS

FIG. 4 is similar to FIG. 5 but showing te first stop plate installed.

DETAILED DESCRIPTION OF THE PREFERRED EMBODIMENT

Figure 1:
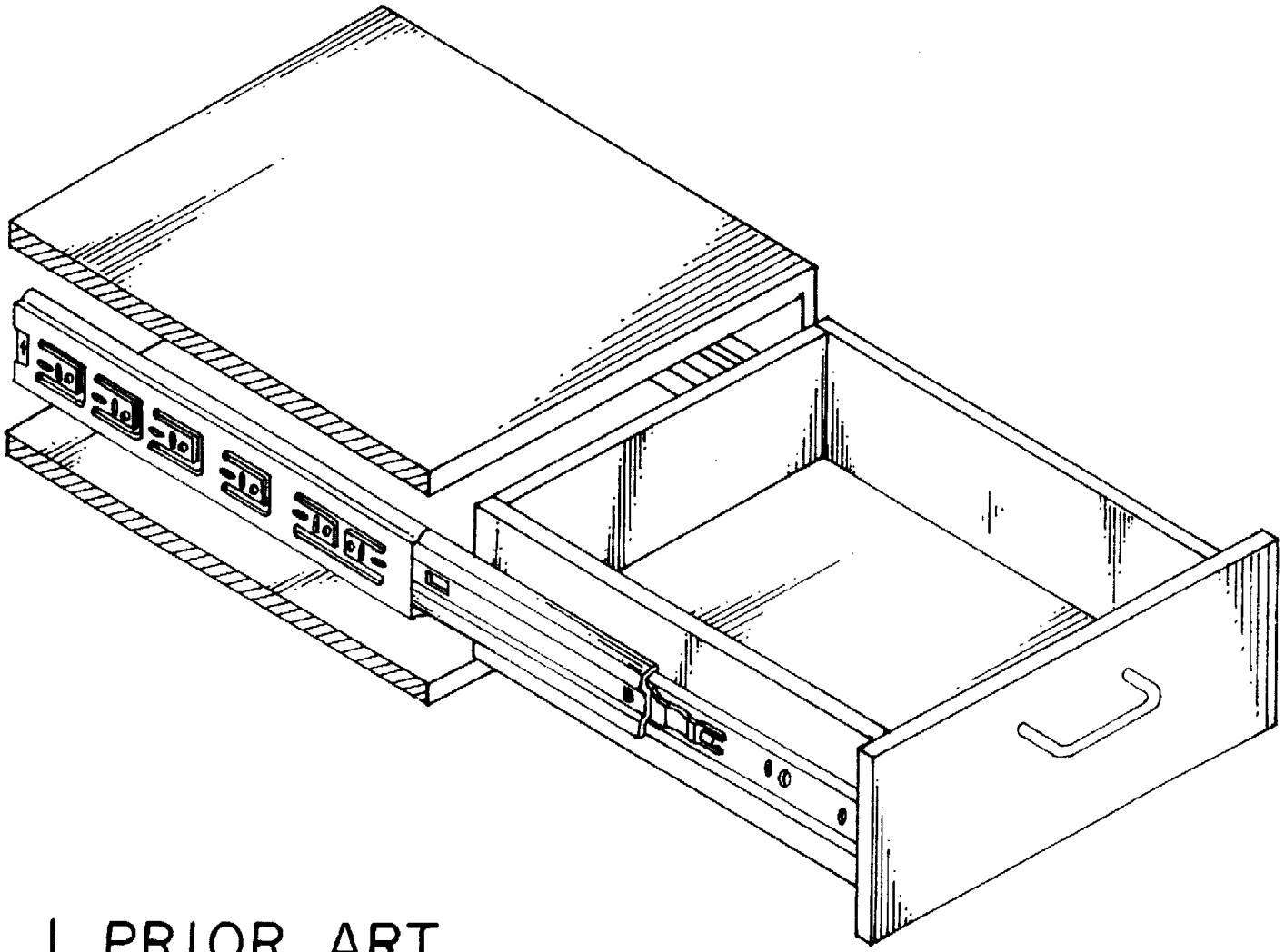
Fig. 1 PRIOR ART
FIG 1 is an installed view of a sliding track assembly according to U.S. Pat. No. 5,577,821.
Figure 2:
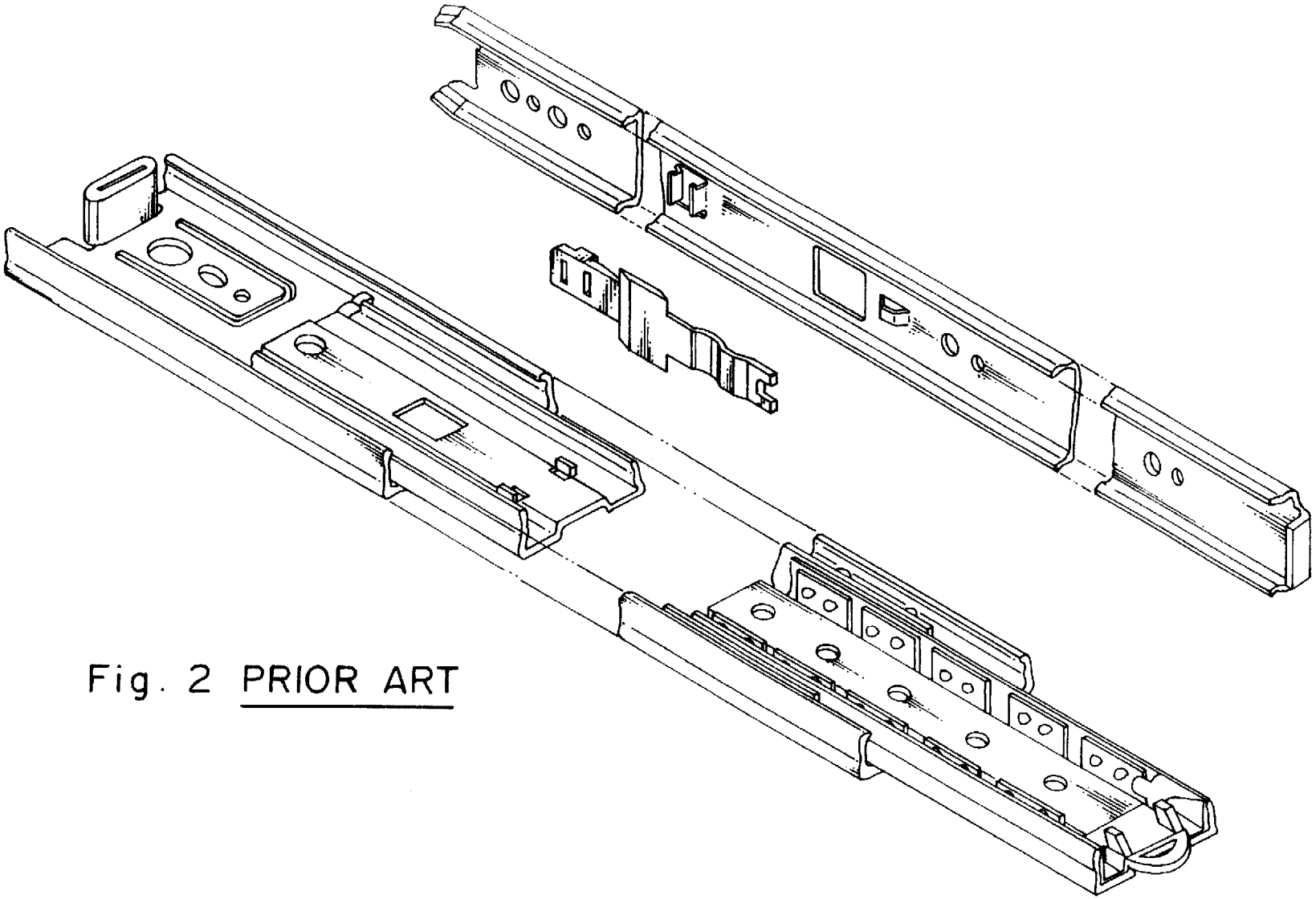
Fig. 2 PRIOR ART
FIG. 2 is an exploded view of the sliding track assembly shown in FIG 1.
Figure 3:
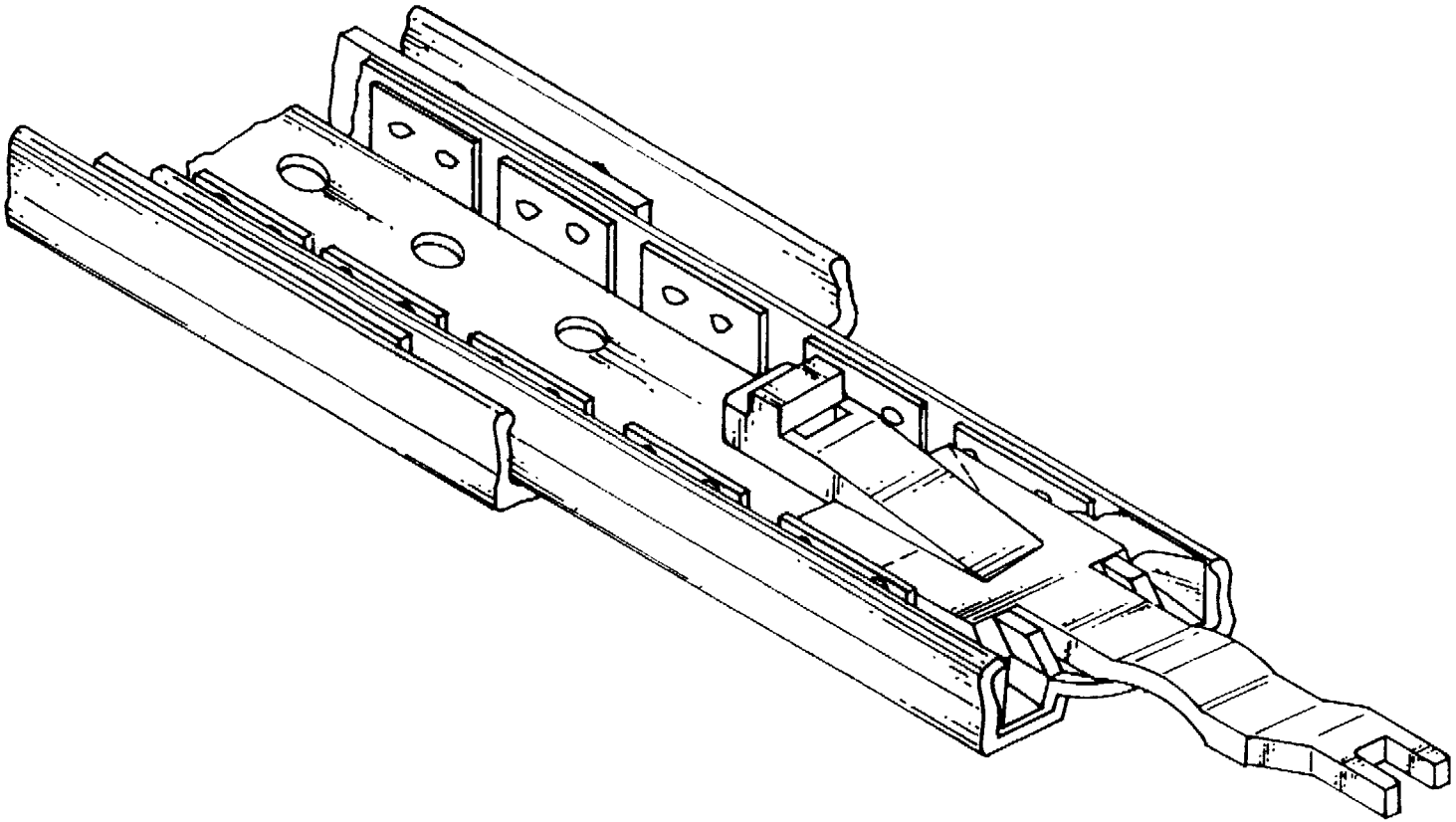
Fig. 3 PRIOR ART
FIG. 3 shows the second stop plate engaged with the first stop plate within the intermediate rail inside the outer rail according to U.S. Pat. No. 5577,821.
Figure 4:
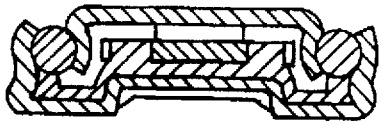
Fig. 4 PRIOR ART
FIG. 4 is a cross sectional view showing the sliding track assembly of FIG. 1 assembled.

Referring to FIGS. from 5 to 15, a sliding track assembly in accordance with the present invention is generally comprised of an outer rail 6 securely fixed to the inside wall of the cabinet, an intermediate rail 7, an inner rail 8 fixedly secured to the drawer at one lateral side, a first sliding ball rack (not shown) slidably connected between the outer rail 6 and the intermediate rail 7, and a second sliding ball rack 92 slidably connected between the intermediate rail 7 and the inner rail 8. A first stop plate 5 is fixed to the outer open end of the intermediate rail 7, having two projecting blocks 51; 52 for engagement with a second stop plate 4 on the inner rail 8 and two stop cods 53; 54 for stopping the second sliding ball rack 92 in place. The second stop plate 4 is fixed to the inner rail 8 at an outer side. When the drawer is moved out of the cabinet, the inner rail 8 is engaged with the projecting blocks 51; 52 of the first stop plate 5, and therefore the drawer does not disconnect from the cabinet. The second stop plate 4 comprises a locating portion 41 of width slightly shorter than the pitch between the two projecting blocks 51; 52 of the first stop plate 5 and of thickness slightly longer than the thickens of the projecting blocks 51; 52, a retaining portion 42 longitudinally extended from one end 411 of the locating portion 41 and made of width slightly longer than the pitch between the two projecting blocks 51; 52 of the first stop plate 5 and defining two opposite projecting portions 421; 422 at two opposite lateral sides, a press portion 43 longitudinally extended from the retaining portion 42 opposite to the locating portion 41 and made of width slightly shorter than the pitch between the two projecting blocks 51; 52 of the first stop plate 5, a forked retaining tail 432 defining a retaining notch 4321, and a bent 431 connected between the press portion 43 and the forked retaining tail 432. The lowest surface portion 4311 of the bent 431 is disposed approximately at the same elevation of the bottom surface portion 412 of the locating portion 41, and therefore a space is defined between the locating portion 41 and the press portion 43 over the retaining portion to match with the through hole 82 on the inner rail 8 (see FIG. 8). Therefore, when the press portion 43 is depressed the retaining portion 42 is forced to curve downwards (see FIGS. 8 and 9), and to disengage from the projecting blocks 51; 52 of the first stop plate 5 for allowing the drawer to be disconnected from the cabinet. The press portion 43 is made of curved shape so that it can be quickly identified by the sense of touch without the sense of sight. When the press portion 43 is released, it immediately returns to its former shape. A sloping surface portion 423 is connected between the retaining portion 42 and the locating portion 41 for guiding the second stop plate 4 through the projecting blocks 51; 52 of the first stop plate 5 into the intermediate rail 7 when the drawer is inserted into the cabinet. When the drawer is inserted into the inside wall of the cabinet, the top sides of the projecting blocks 51; 52 are guided by the sloping surface portion 423 and moved over the top side 424 of the retaining portion 42 until the projecting blocks 51 ; 52 are moved into engagement with the projection portions 421; 422 of the retaining portion 42. When the drawer is set into position, it can be moved in and out of the cabinet. However, when the drawer is pulled out of the cabinet, the projecting portion 421; 422 of the retaining portion 42 will be forced into engagement with the projecting blocks 51; 52, and therefore the drawer is stopped in place. When to disconnect the drawer From the cabinet, it can easily be done by depressing the press portion 43 of the second stop plate 4 to curved the retaining portion 42 toward the through hole 82 of the inner rail 8 (see FIG. 9), and to disengage the projecting portions 421 ;422 of the second stop plate 4 from the projecting blocks 51; 52 of the first stop plate 5. The projecting portions 421; 422 have a respective sloping surface portion 4211 or 4221 which engages with the sloping surface portion 511 or 521 of the respective projecting block 51 or 52 when the drawer is moved out of the cabinet. The first stop plate 5 further comprises an arched front end 540 projecting out of the front end of the intermediate rail 7.

Figure 8:
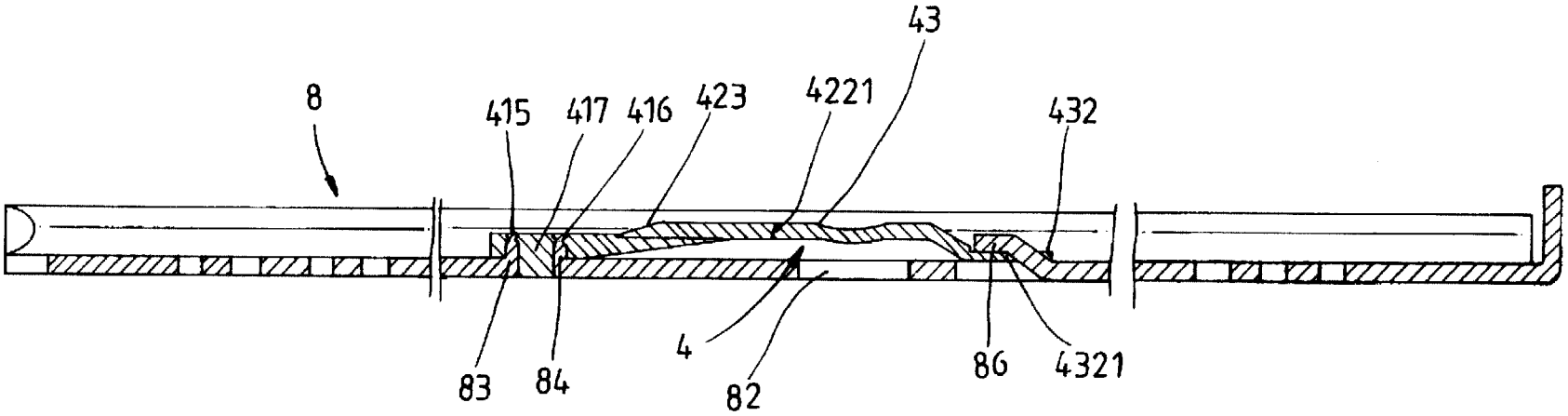
FIG. 8 is a longitudinal view in section showing the second stop plate fastened to the inner rail according to the present invention.
Figure 9:
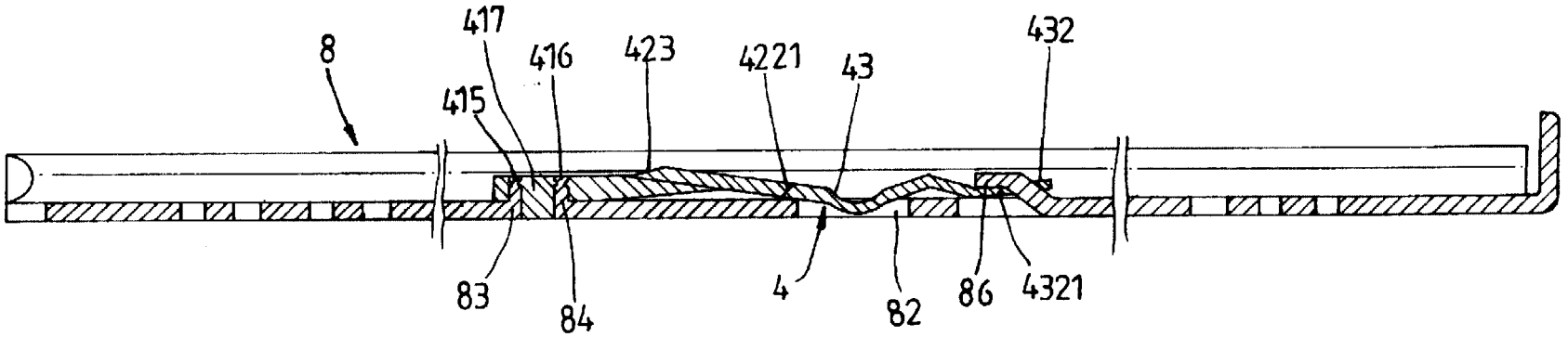
FIG. 9 is similar to FIG. 8 but showing the press portion of the second stop plate depressed and the retaining portion thereof curved toward the through hole on the inner rail.
Figure 11:
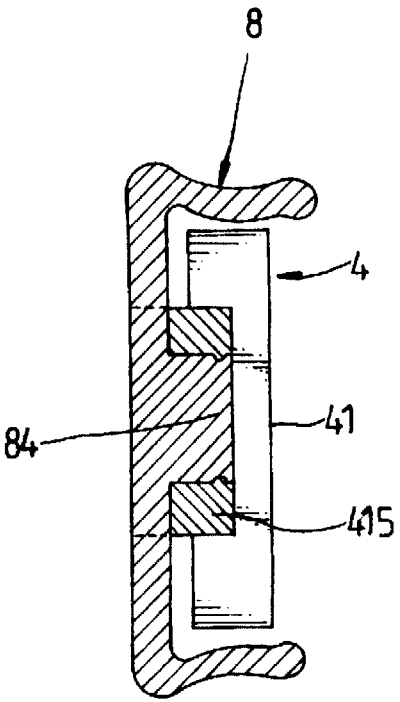
FIG. 11 a sectional view taken along line 11—11 of FIG.
Figure 10:
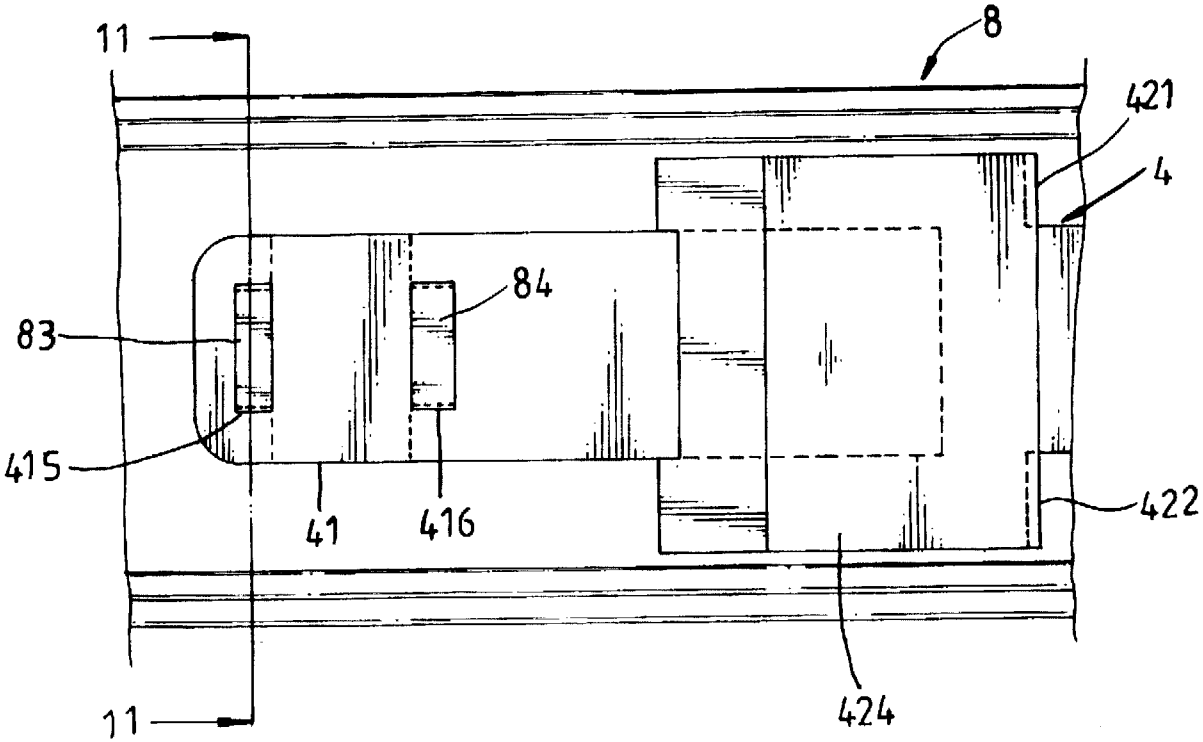
FIG. 10 is a plain view in an enlarged scale showing the second stop plate fastened to the inner rail according to the present invention.
Figure 12:
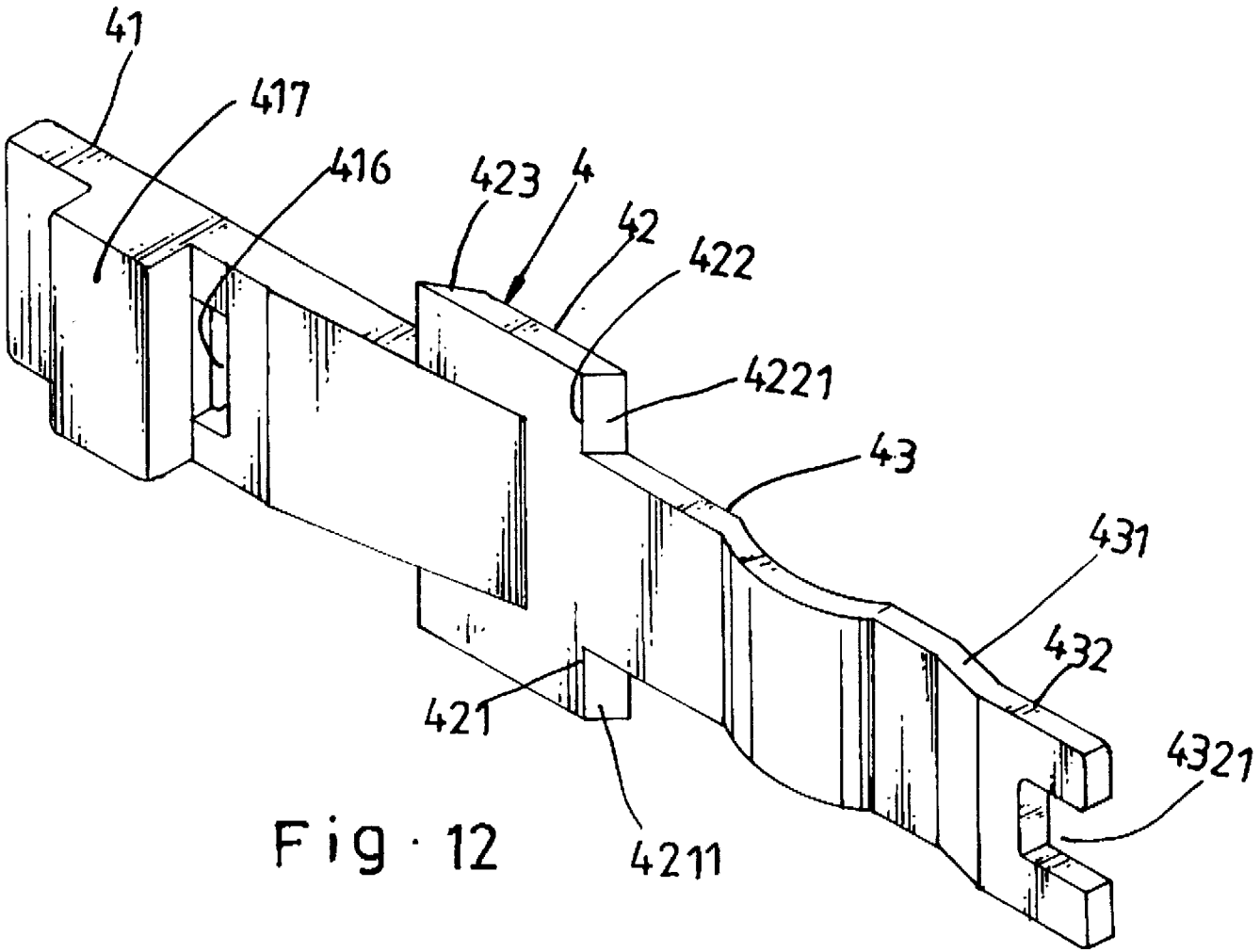
FIG. 12 is an elevational view of the second stop plate taken from another angle according to the present invention.
Figure 13:
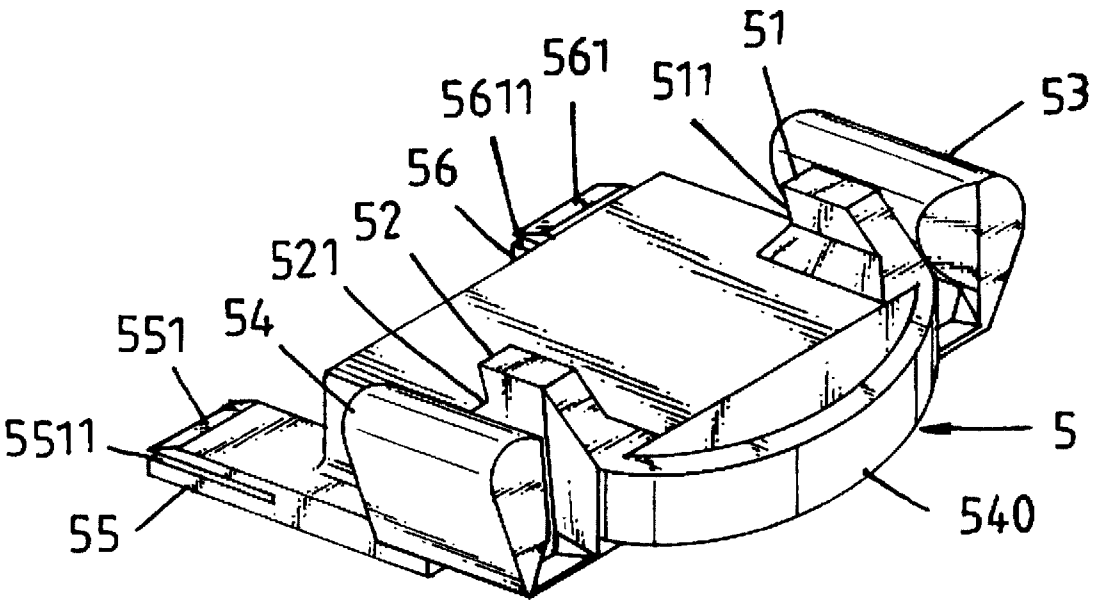
FIG. 13 is an elevational view in an enlarged scale of the first stop plate according to the present invention.
Figure 14:
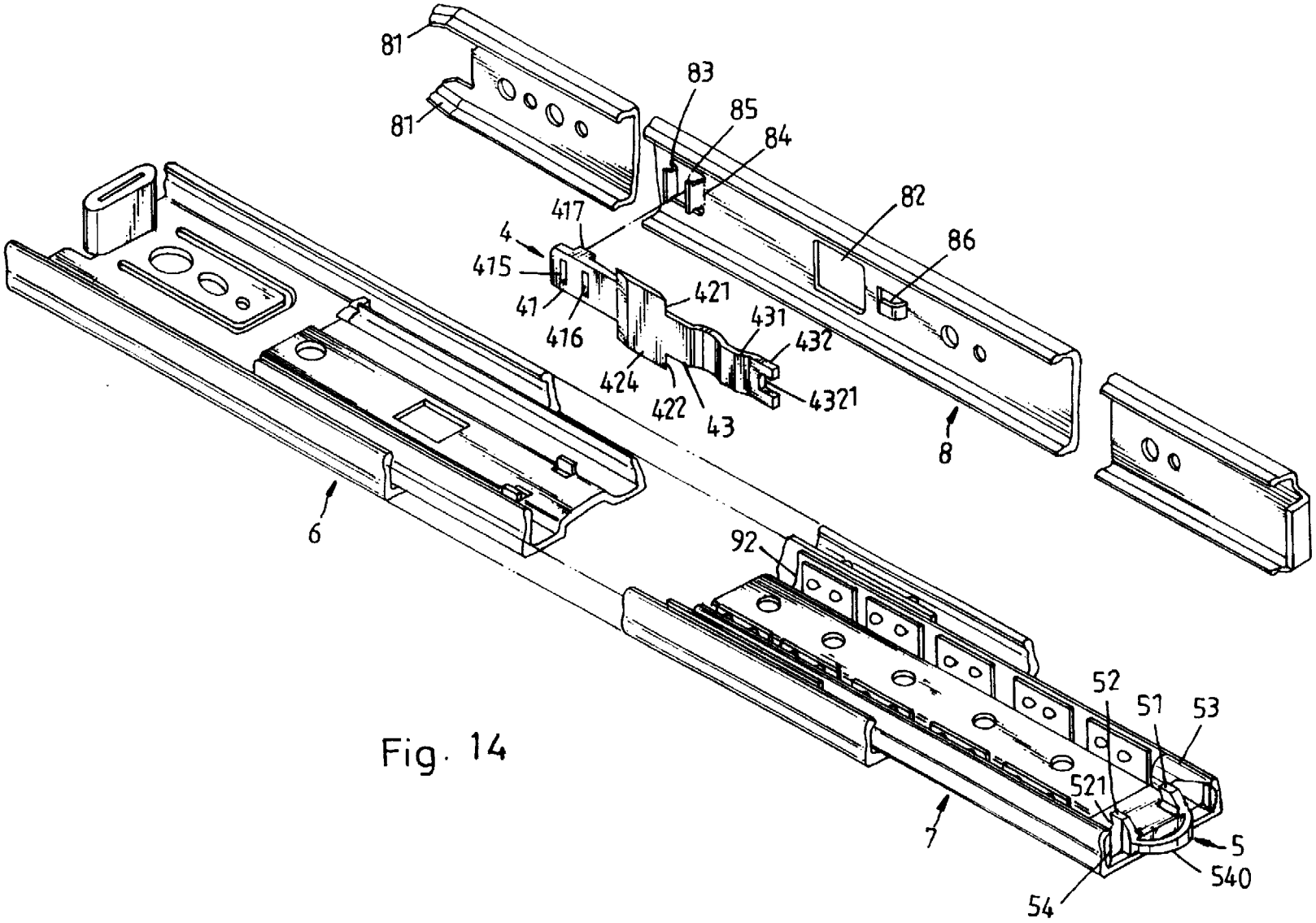

Referring to FIGS. 8 and 12, the locating portion 41 of the second stop plate 4 comprises a projecting block 417 and two locating holes 415; 416 at two opposite sides relative to the projecting block 417; the inner rail 8 is made from a metal plate by a stamping machine, having a locating hole 85 and two locating strips 83; 84 extended from the periphery of te locating hole 85 at two opposite sides in the same direction. By fitting the projecting block 417 of the locating portion 41 of the second stop plate 4 into the two orating hole 85 of the inner rail 8 and hooking the two locating strips 83; 84 of the inner rail 8 on the locating holes 415; 416 of the locating portion 41 of the second stop plate 4, the second stop plate 4 is fixed to the inner rail 8. This mounting procedure can be performed by an automatic machine without the use of any rivet. The inner rail 8 further comprises an unitary retainer rod 86 engaged with the retaining notch 4321 on the forked retaining tail 432 of the second stop plate 4 to hold down the second stop plate 4 in place. Because the two opposite ends (the locating portion 41 and the forked retaining tail 432 ) are respectively stopped at the locating hole 85 and the retainer rod 86, the retaining portion 42 is forced to curve toward the through hole 82 when the press portion 43 is depressed (see FIGS. 8 and 9).

Figure 5:
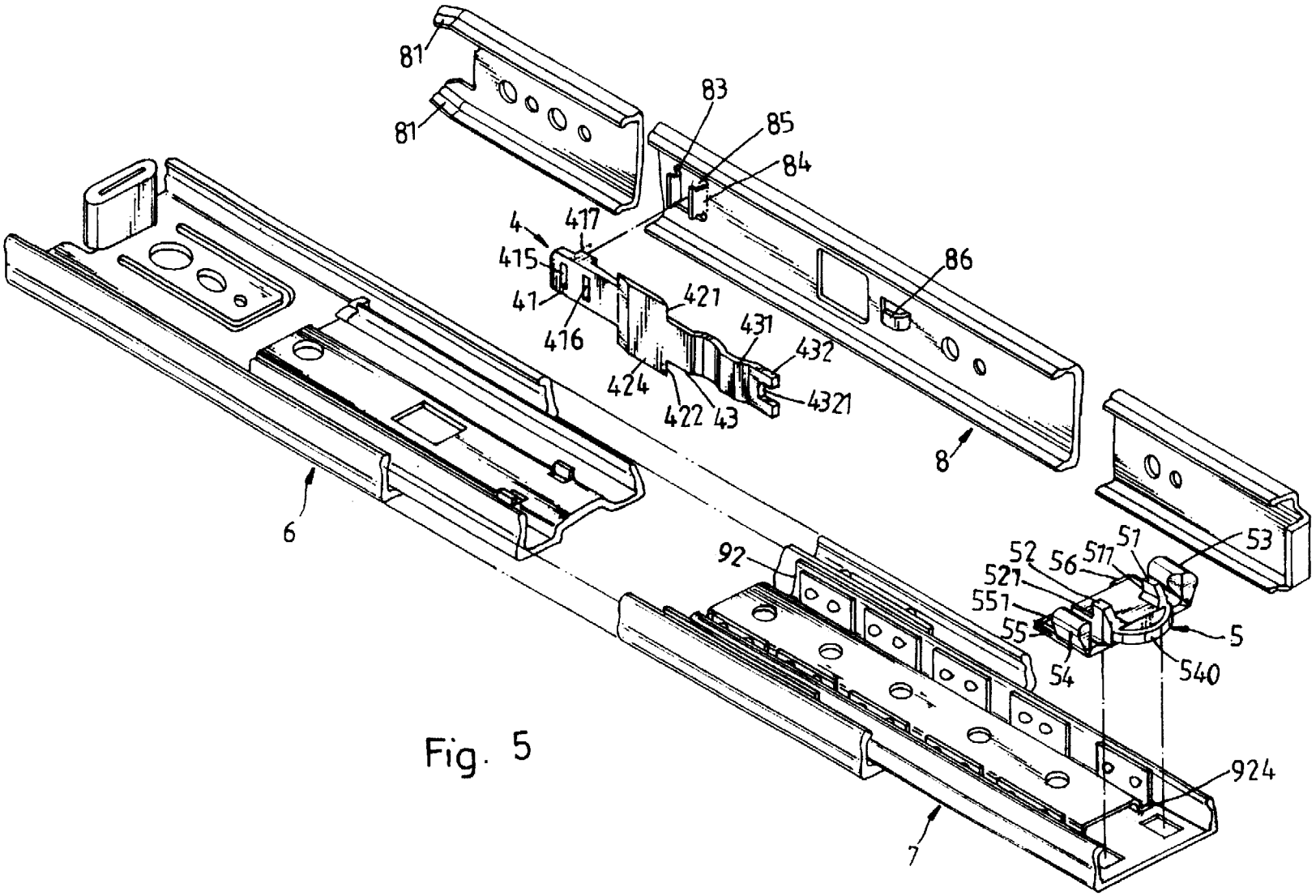
FIG. 5 is an exploded view of a sliding track assembly according to the present invention.
Figure 6:
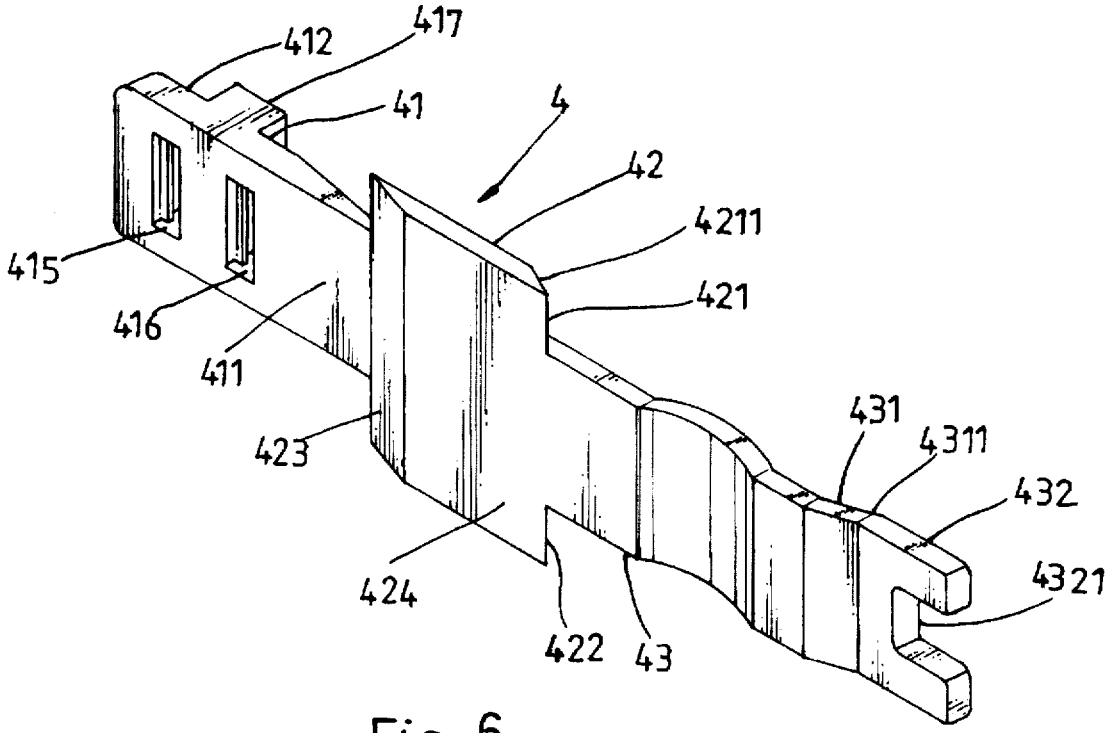
FIG. 6 is an elevational view in an enlarged scale of the second stop plate according to the present invention.
Figure 7:
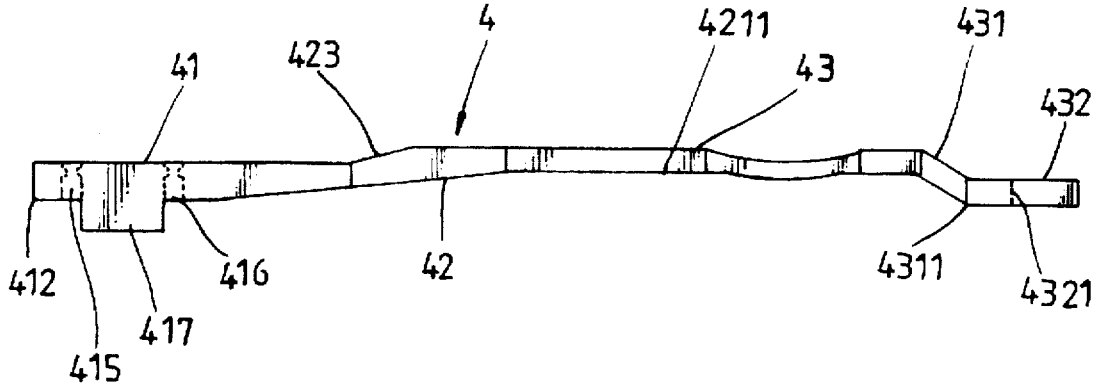
FIG. 7 is a side view of the second stop plate shown in FIG. 6.
Figure 15:
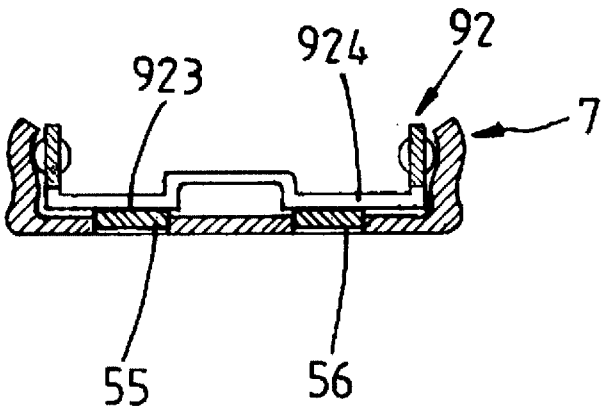
FIG. 15 is a cross sectional view in an enlarged scale of the intermediate rail according to the present invention.

Referring to FIGS. from 13 and 15, the first stop plate 5 further comprises two locating plates 55; 56 bilaterally backwardly extended from the bottom. The locating plate 55 or 56 has a rear bevel edge 551 or 561 at the top, and a longitudinal split 5511 or 5611 below the bevel edge 551 or 561. The second sliding ball rack 92 has two sliding faces 923; 924 bilaterally disposed at the bottom. When the drawer is pulled out of the cabinet and the inner rail 8 is moved with the drawer to force the second sliding ball rack 92 into engagement with the first stop plate the bevel edges 551; 561 of the locating plates 55; 56 guide the sliding faces 923; 924 of the second sliding ball rack 92 into close contact with the locating plates 55; 56 of the first stop plate 5 (see FIGS. 5 and 15). Because of the design of the longitudinal splits 5511; 5611, less friction force is produced between the locating plates 55; 56 of the first stop plate 5 and the second sliding ball rack 92. The longitudinal splits 5511; 5611 impart a springy force to the bevel edges 551; 561, enabling the sliding faces 923; 924 of the second sliding ball rack 92 to be smoothly moved into engagement with the locating plates 55; 56 without producing much friction force.

I claim:

1. A sliding track assembly comprising an outer rail securely fixed to an inside wall of cabinet, an intermediate rail, an inner rail fixedly secured to a drawer at one lateral side, a first sliding ball rack slidably connected between said outer rail and said intermediate rail and a second sliding ball rack slidably connected between said intermediate rail and said inner rail, a first stop plate fixed to said intermediate rail at an outer end and having two projecting blocks for engagement with a second stop plate on said inner rail and two stop rods for stopping said second sliding ball rack in place, a second stop plate fixed to said inner rail at an outer side, said second stop plate being engaged with the projecting blocks of said first stop plate to stop said drawer in place when said drawer is pulled out of said cabinet, said second stop plate comprising a locating portion of width smaller than the pitch between the two projecting blocks of said first stop plate and of thickness longer than the thickness of the projecting blocks of said first stop plate, the locating portion of said second stop plate being fixed to said inner rail, a retaining portion longitudinally extended from one end of the locating portion of said second stop plate and made width longer than the pitch between the two projecting blocks of said first stop plate and defining two opposite projecting portions at two opposite lateral sides, a press portion longitudinally extended from the retaining portion of said second stop plate opposite to the locating portion of said second stop plate and made of width smaller than the pitch between the two projecting blocks of said first stop plate, a forked retaining tail defining a retaining notch and fastened to said inner rail, and a bent connected between said press portion and said forked retaining tail, the retaining portion and press portion of said second stop plate being spaced from said inner tail by a space, the retaining portion of said second stop plate being forced to curve toward said inner rail and to disengage from said first stop plate when said press portion is depressed, for permitting said drawer to be disconnected from said cabinet, the retaining portion of said second stop plate having a sloping surface portion connected to the locating portion of said second stop plate and two projecting portions remote from the sloping surface portion thereof, the sloping surface portion of the retaining portion of said second stop plate guiding said second stop plate through said intermediate rail when said drawer is inserted into said cabinet, the projecting blocks of said first stop plate having a respective top side, which is guided by the sloping surface portion of the retaining portion of said second stop plate to pass over the retaining portion of said second stop plate into engagement with the two projecting portions on the retaining portion of said second stop plate when said drawer is inserted into the inside wall of said cabinet, the projecting portions of the retaining portion of said second stop plate being engaged with the projecting blocks of said first stop plate to stop said drawer in place when said drawer is pulled out of said cabinet, said drawer being disconnected from said cabinet when said press portion of said second stop plate is depressed to curve the retaining portion of said second stop plate and to disengage the projecting portions of the retaining portion of said second stop plate from the projecting blocks of said first stop plate, wherein: said first stop plate further comprises two locating plates bilaterally backwardly extended from a bottom side thereof, said locating plates each having a rear bevel edge at the top, and a longitudinal split below said bevel edge; said second sliding ball rack has two sliding faces bilaterally disposed at a bottom side thereof; the bevel edges of said locating plates guide the sliding faces of said second sliding ball rack into close contact with the locating plates of said first stop plate when said drawer is pulled out of said cabinet and said inner rail is moved with said drawer to force said second sliding ball rack into engagement with said first stop plate; the longitudinal splits of the locating plates of said first stop plate impart a springy force to the bevel edges of said locating plates of said first stop plate, enabling the sliding faces of said second sliding ball rack to be moved into engagement with said locating plates to said first stop plate.

* * * * *